US009247350B2

(12) United States Patent
French

(10) Patent No.: US 9,247,350 B2
(45) Date of Patent: Jan. 26, 2016

(54) ACOUSTIC TRANSDUCER ASSEMBLY

(71) Applicant: Harman Becker Gepkocsirendszer Gyarto Korlatolt Felelossegu Tarsasag, Szekesfehervar (HU)

(72) Inventor: John B. French, Caledon East (CA)

(73) Assignee: Harman Becker Gepkocsirendszer Gyarto Korlatolt Felelossegu Tarsasag, Szekesfehervar (HU)

( * ) Notice: Subject to any disclaimer, the term of this patent is extended or adjusted under 35 U.S.C. 154(b) by 0 days.

(21) Appl. No.: 13/761,692

(22) Filed: Feb. 7, 2013

(65) Prior Publication Data

US 2014/0010402 A1 Jan. 9, 2014

Related U.S. Application Data

(60) Provisional application No. 61/668,795, filed on Jul. 6, 2012, provisional application No. 61/670,301, filed on Jul. 11, 2012.

(51) Int. Cl.

| | |
|---|---|
| ***H04R 1/00*** | (2006.01) |
| ***H04R 9/04*** | (2006.01) |
| ***H04R 9/06*** | (2006.01) |
| ***H04R 9/02*** | (2006.01) |

(52) U.S. Cl.

CPC ..... *H04R 9/04* (2013.01); *H04R 9/025* (2013.01); *H04R 9/06* (2013.01); *H04R 9/063* (2013.01)

(58) Field of Classification Search

USPC ..... 381/412, 414, 401, 406

See application file for complete search history.

(56) References Cited

U.S. PATENT DOCUMENTS

| | | | | |
|---|---|---|---|---|
| 2,027,473 | A | 1/1936 | Creager et al. | |
| 5,832,096 | A * | 11/1998 | Hall | H04R 9/063 381/400 |
| 6,175,637 | B1 | 1/2001 | Fujihira et al. | |
| 6,639,994 | B1 * | 10/2003 | Proni et al. | 381/406 |
| 6,963,650 | B2 | 11/2005 | Combest | |
| 7,006,654 | B2 | 2/2006 | Stiles et al. | |
| 8,111,870 | B2 * | 2/2012 | Lemarquand | H04R 9/025 381/412 |
| 2004/0005075 | A1 * | 1/2004 | Kobayashi et al. | 381/414 |
| 2004/0086145 | A1 | 5/2004 | Stiles | |
| 2004/0131223 | A1 | 7/2004 | Stiles | |
| 2004/0156527 | A1 | 8/2004 | Stiles et al. | |
| 2006/0239496 | A1 | 10/2006 | Stiles et al. | |
| 2009/0190794 | A1 | 7/2009 | French et al. | |
| 2014/0254860 | A1 | 9/2014 | French | |

OTHER PUBLICATIONS

International Preliminary Report for corresponding Application No. PCT/CA2013/000110, mailed Jan. 15, 2015, 6 pages.

International Search Report for Application No. PCT/CA2014/000177, Jun. 17, 2014, 3 pages.

(Continued)

*Primary Examiner* — Davetta W Goins
*Assistant Examiner* — Amir Etesam
(74) *Attorney, Agent, or Firm* — Brooks Kushman P.C.

(57) ABSTRACT

Driver for an acoustic transducer having a moving coil of substantially equal length to the air gap. The air gap may itself be extended in length using an upper or lower lip, or both. A stationary coil is also provided. The moving and stationary coils can be controlled by suitable control blocks to form an electromagnet-based transducer with reduced distortion.

17 Claims, 16 Drawing Sheets

(56) References Cited

OTHER PUBLICATIONS

U.S. Office Action for U.S. Appl. No. 14/196,726, mailed Jan. 15, 2015, 16 pages.

Gander, "Moving-Coil Loudspeaker Topology as an Indicator of Linear Excursion Capability", J. Audio. Eng. Soc., vol. 29, No. 1/2, Jan./Feb. 1981, 17 pages.

* cited by examiner

ACOUSTIC TRANSDUCER ASSEMBLY

CROSS-REFERENCE TO RELATED APPLICATIONS

This application claims priority to U.S. Provisional Patent Application No. 61/668,795, filed Jul. 6, 2012 and U.S. Provisional Patent Application No. 61/670,301, filed Jul. 11, 2012. The entire contents of each of U.S. Provisional Patent Application Nos. 61/668,795 and 61/670,301 are hereby incorporated by reference.

FIELD

The embodiments described herein relate to acoustic transducers. In particular, the described embodiments relate to drivers for use in acoustic transducers.

BACKGROUND

Many acoustic transducers or drivers use a moving coil dynamic driver to generate sound waves. In most transducer designs, a magnet provides a magnetic flux path with an air gap. The moving coil reacts with magnetic flux in the air gap to move the driver. Initially, an electromagnet was used to create a fixed magnetic flux path. These electromagnet based drivers suffered from high power consumption and loss. Acoustic drivers can also be made with permanent magnets. While permanent magnets do not consume power, they have limited BH products, can be bulky and depending on the magnetic material, can be expensive. In contrast the electromagnet based drivers do not suffer from the same BH product limitations.

Recently, more efficient electromagnet-based acoustic transducers have been developed that incorporate the advantages of electromagnets while reducing the effect of some of their disadvantages. However, in electromagnet-based acoustic transducers, non-linearities in the magnetic flux across the air gap can introduce undesirable artifacts in the sound that is reproduced. There is a need to minimize or eliminate such non-linearities.

SUMMARY

In a broad aspect, there is provided a driver for an acoustic transducer comprising: a moving diaphragm; a driver body formed of a magnetic material, the driver body comprising: a center post; an outer wall coupled to the center post via a bottom portion of the driver body; and an annular plate extending inwardly toward the center post from the outer wall; a moving coil coupled to the diaphragm, the moving coil disposed at least partially within an air gap formed between the annular plate and the center post; and a stationary coil disposed within a cavity defined by the annular plate, outer wall, bottom portion and center post.

In some cases, the annular plate comprises an upper lip disposed at an inward end of the annular plate, the upper lip extending away from the cavity to extend the air gap. In some cases, the air gap has a greater width at an outward portion of the upper hp than at a central portion of the annular plate. In some cases, width of the upper lip is tapered to be narrower as the upper lip extends away from the annular plate.

In some cases, the annular plate comprises a lower lip disposed at an inward end of the annular plate, the lower lip extending into the cavity to extend the air gap. In some cases, the air gap has a greater width at an outward portion of the lower lip than at a central portion of the annular plate. In some cases, width of the lower lip is tapered to be narrower as the lower lip extends away from the annular plate.

In some cases, the moving coil has a moving coil length that is substantially equal to an air gap length of the air gap. The moving coil length may be at least 400% of a maximum excursion of the moving coil.

In some cases, the driver body has a tapered outer corner between the bottom portion and the outer wall. In some cases, the driver body has a tapered outer corner between the outer wall and the annular plate. In some cases, the driver body has a tapered upper interior portion of the center post.

In some cases, an inward face of the annular plate is not parallel to the center post. In some cases, the air gap is wider at an outer portion of the air gap and narrower at a central portion of the air gap.

In some embodiments, the driver further comprises at least one additional annular plate, the at least one additional annular plate defining at least one additional air gap and at least one additional cavity.

In some cases, an inward portion of the at least one additional annular plate is coupled to an upper portion of the center post, further comprising an additional stationary coil disposed within the at least one additional cavity, wherein the additional stationary coil has an additional flux path rotating in the opposite direction to a flux path of the stationary coil.

In some embodiments, the driver further comprises at least one additional moving coil respectively disposed within the at least one additional air gap; and at least one additional stationary coil respectively disposed within the at least one additional cavity.

In another broad aspect, there is provided an acoustic transducer comprising: an audio input terminal for receiving an input audio signal; a control system for: producing at least one time-varying stationary coil signal, wherein the stationary coil signal corresponds to the audio input signal; and producing at least one time-varying moving coil signal, wherein the moving coil signal corresponds to the audio input signal and the stationary coil signal; and a driver according to the embodiments described herein, the driver electrically coupled to the control system.

Additional features of various aspects and embodiments are described below.

BRIEF DESCRIPTION OF THE DRAWINGS

Several embodiments of the present invention will now be described in detail with reference to the drawings, in which.

Various features of the drawings are not drawn to scale in order to illustrates various aspects of the embodiments described below. In the drawings, corresponding elements are, in general, identified with similar or corresponding reference numerals.

DETAILED DESCRIPTION OF EXEMPLARY EMBODIMENTS

Figure 1:
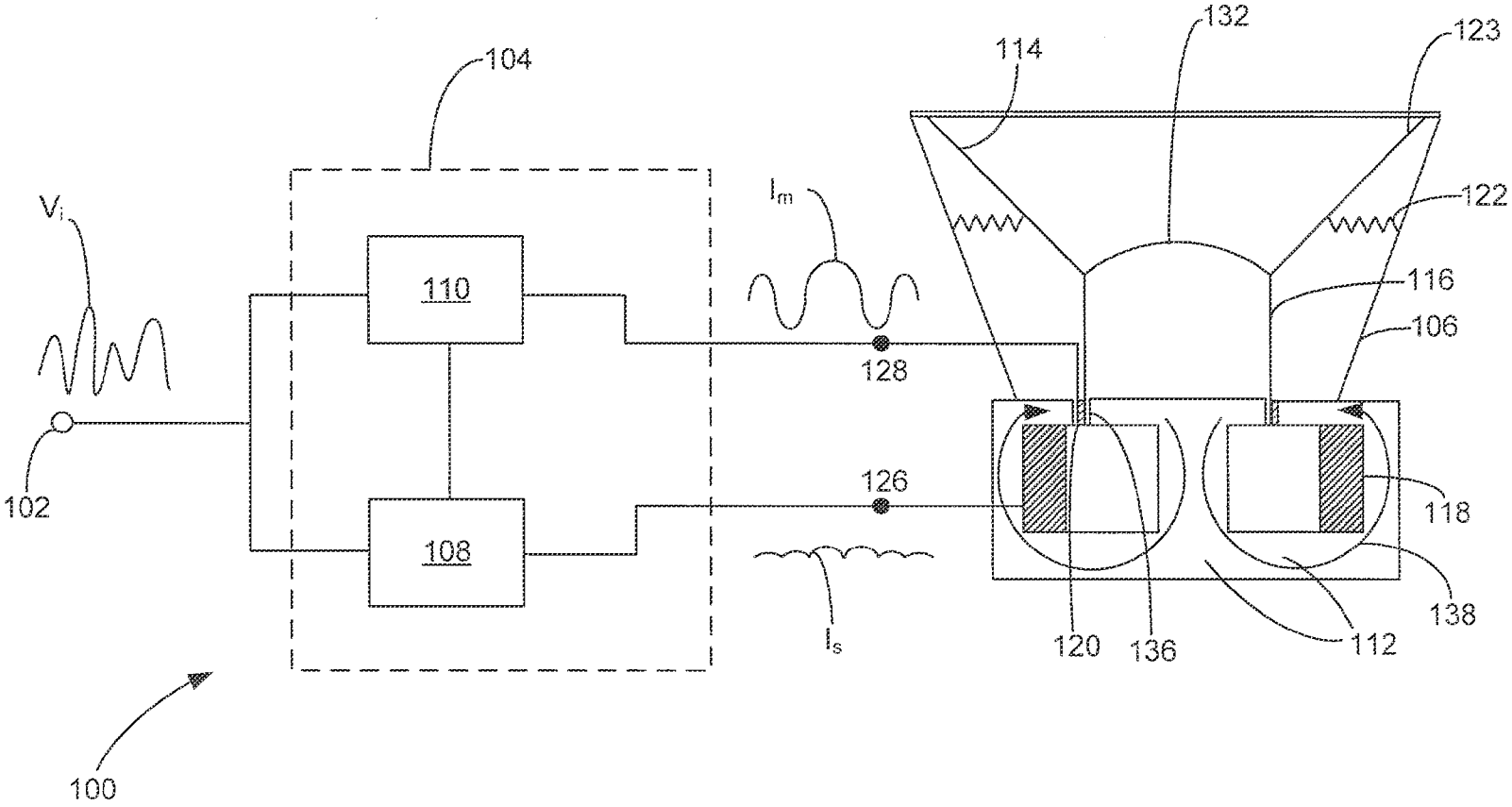
FIG. 1 is a section view of an example electromagnet-based acoustic transducer.
Figure 2:
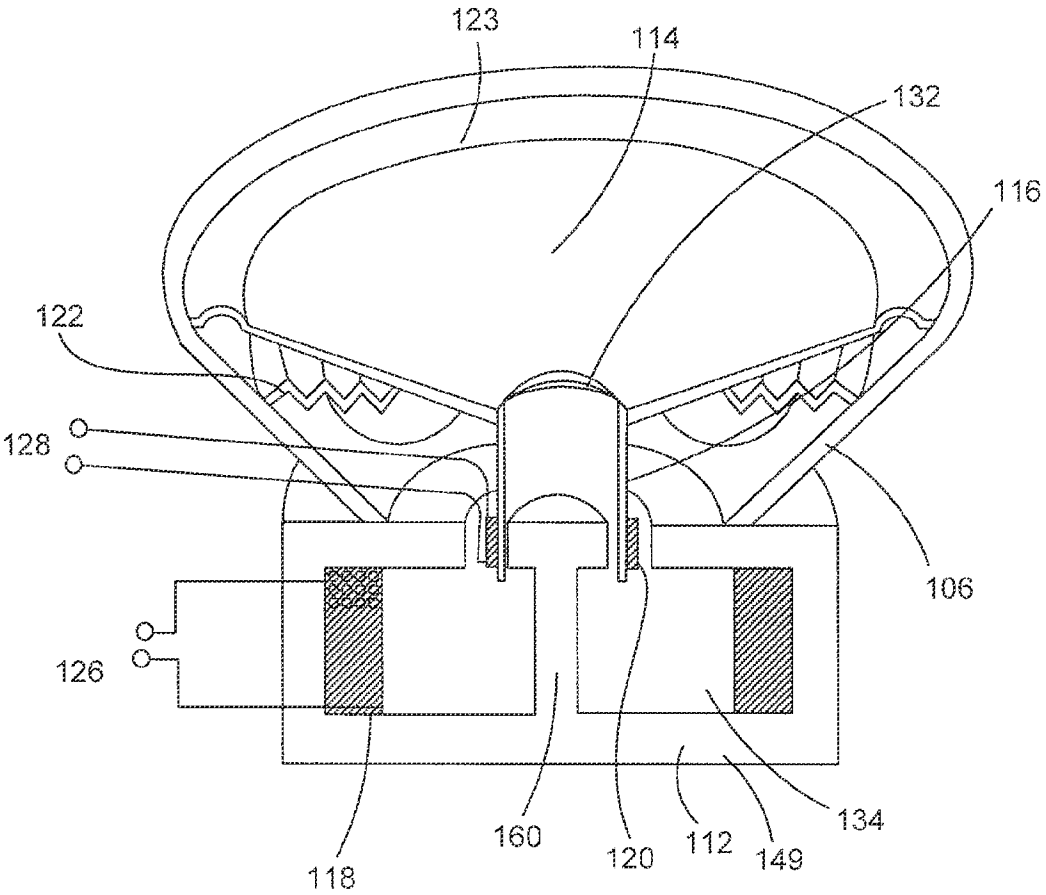
FIG. 2 is an oblique view of the example acoustic transducer of FIG. 1.

Reference is first made to FIGS. 1 and 2, which illustrate an example electromagnet-based acoustic transducer 100. Transducer 100 has an input terminal 102, a control block 104, and a driver 106. FIG. 1 illustrates driver 106 in cross-section and the remaining parts of transducer 100 in block diagram form. FIG. 2 illustrates portions of transducer 100, including driver 106, in greater detail in an oblique view.

Control block 104 includes a stationary coil signal generation block 108 and a moving coil signal generation block 110. Each of the stationary and moving coil signal generation blocks is coupled to the input terminal 102. In operation, an input audio signal $V_i$ is received at input terminal 102, and is transmitted to both the stationary coil signal generation block 108 and the moving coil generation block 110. Stationary coil signal generation block 108 generates a stationary coil signal $I_s$ at node 126 in response to the input signal $V_i$. Similarly, the moving coil signal generation block 110 generates a moving coil signal $I_m$ at node 128 in response to the input signal $V_i$.

Driver 106 includes a driver body comprised of magnetic material 112, a diaphragm 114, a moving coil former 116, a stationary coil 118 and a moving coil 120. Driver 106 also includes an optional diaphragm support or spider 122 and a surround 123.

The driver body formed of magnetic material 112 is generally toroidal and has a toroidal cavity 134. In particularly, driver body may comprise a center post 160, a bottom portion 149 and an outer wall 148. Stationary coil 118 is positioned within cavity 134. In various embodiments, magnetic material 112 may be formed from one or more parts, which may allow stationary coil 118 to be inserted or formed within cavity 134 more easily. Magnetic material 112 is magnetized in response to the stationary coil signal, producing magnetic flux in the magnetic material. Magnetic material has an annular or toroidal air gap 136 in its magnetic circuit 138 and magnetic flux flows through and near the air gap 136.

Magnetic material 112 may be formed of any material that is capable of becoming magnetized in the presence of a magnetic field. In various embodiments, magnetic material 112 may be formed from two or more such materials. In some embodiments, the magnetic material may be formed from laminations. In some embodiments, the laminations may be assembled radially and may be wedge shaped so that the composite magnetic material is formed with no gaps between laminations.

Moving coil 120 is mounted on moving coil former 116. Moving coil 120 is coupled to moving coil signal generation block 110 and receives the moving coil signal $I_m$. Diaphragm 114 is mounted to moving coil former 116 such that diaphragm 114 moves together with moving coil 120 and moving coil former 116. The moving coil 120 and moving coil former 116 move within air gap 136 in response to the moving coil signal $I_m$ and the flux in the air gap. Components of acoustic transducer that move with the moving coil former may be referred to as moving components. Components that are stationary when the moving coil former is in motion may be referred to as stationary components. Stationary components of the acoustic transducer include magnetic material 112 and the stationary coil 118.

In various embodiments, the acoustic transducer may be adapted to vent the air space between the dust cap 132 and magnetic material 112. For example, a aperture may be formed in the magnetic material, or apertures may be formed in the moving coil former to allow vent the air space, thereby reducing or preventing air pressure from affecting the movement of the diaphragm.

Control block 104 generates the stationary and moving coil signals in response to the input signal $V_i$ such that diaphragm 114 generates audio waves 140 corresponding to the input signal $V_i$.

The stationary and moving coil signals correspond to the input signal and also correspond to one another. Both of the signals are time-varying signals, in that the magnitude of the signals need not be fixed at a single magnitude during operation of the acoustic transducer. Changes in the stationary coil signal $I_s$ produce different levels of magnetic flux in the magnetic material 112 and the air gap 136. Changes in the moving coil signal $I_m$ cause movement of the diaphragm 114, to produce sound corresponding to the input audio signal $V_i$. In the embodiment shown, the stationary and moving coil signal generation blocks are coupled to one another. The stationary coil signal $I_s$, or a version of the stationary coil signal, is provided to the moving coil signal generation block 110. The moving coil signal generation block 110 is adapted to generate the moving coil signal $I_m$ partially in response to the stationary coil signal $I_s$ as well as the input signal $V_i$.

In other embodiments, the stationary coil signal may be generated in response to the moving coil signal and input signal. In some other embodiments, the moving and stationary coil signal generation blocks may not be coupled to one another, but one or both of the blocks may be adapted to estimate or model the coil signal generated by the other block and then generate its own respective coil signal in response to the modeled coil signal and the input signal.

The design and operation of electromagnet-based acoustic transducers, including further detail of the moving and stationary coil signal generation blocks is described in U.S. Pat. No. 8,139,816, the entirety of which is incorporated herein by reference.

Commonly, in acoustic transducers, an "overhung" topology is used for the moving coil, in which the length of the moving coil 120 exceeds the length of the air gap 136. Conversely, in some other acoustic transducers, an "underhung" topology may be used for the moving coil, in which the length of the moving coil 120 is less than the length of the air gap 136.

Figure 3A:
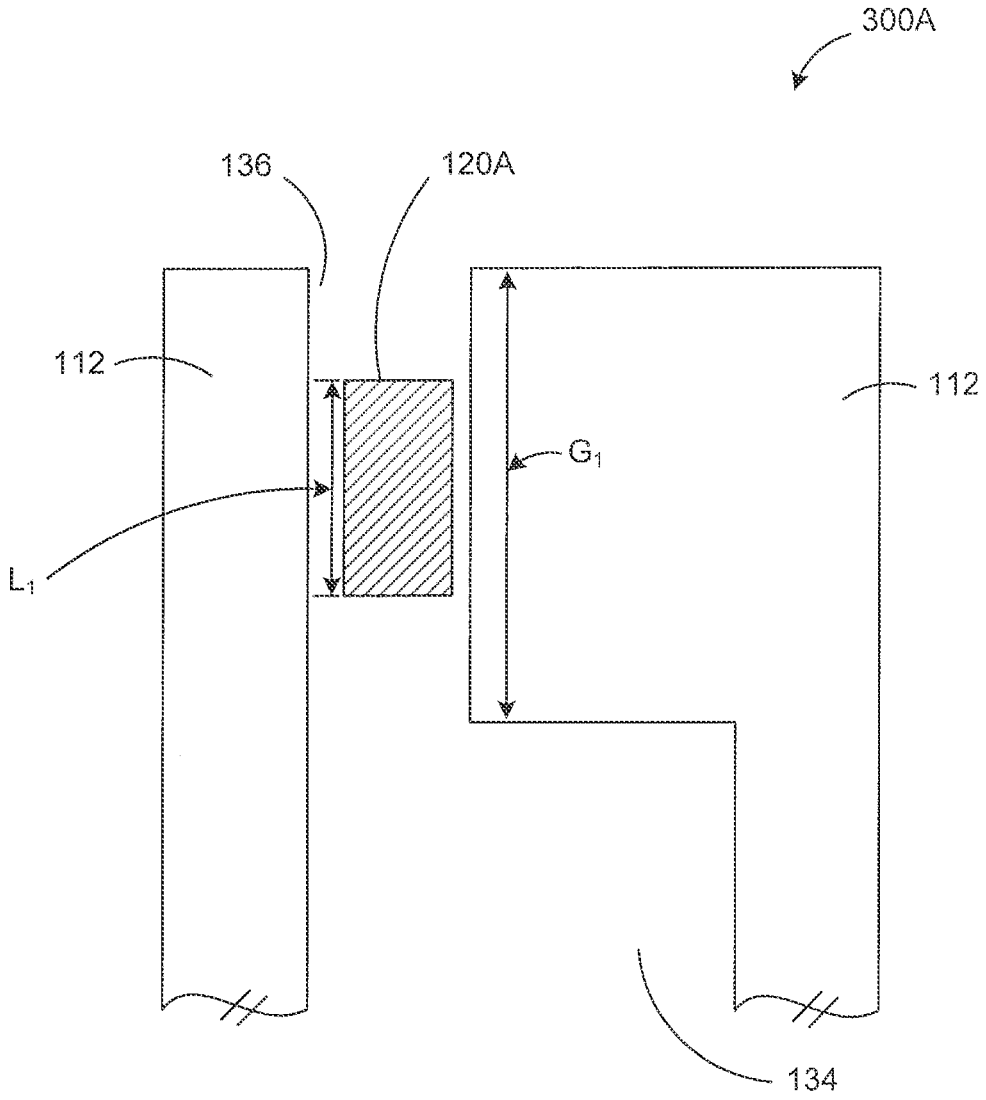
FIGS. 3A to 3C are detailed section views of the air gap of an acoustic transducer according to various example embodiments.
Figure 3B:
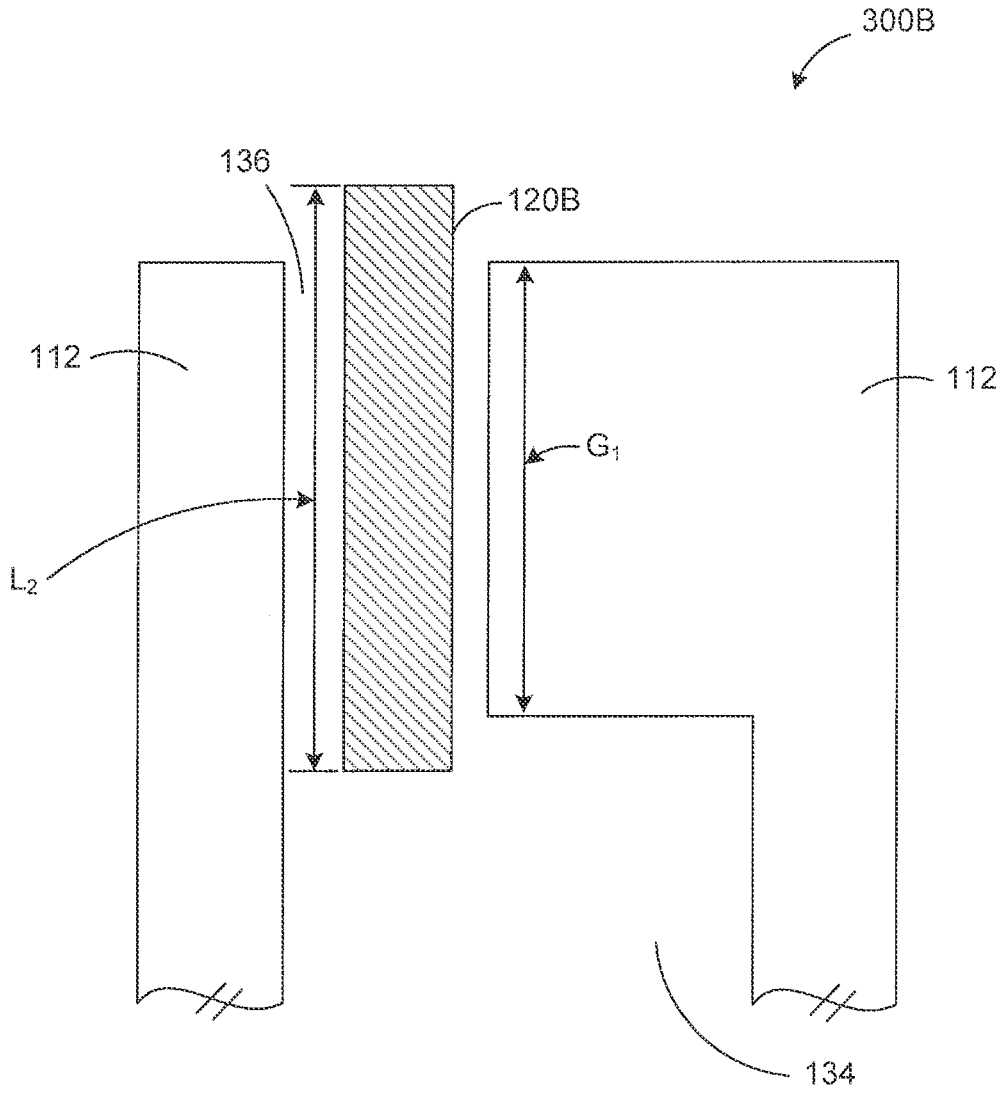
Figure 3C:
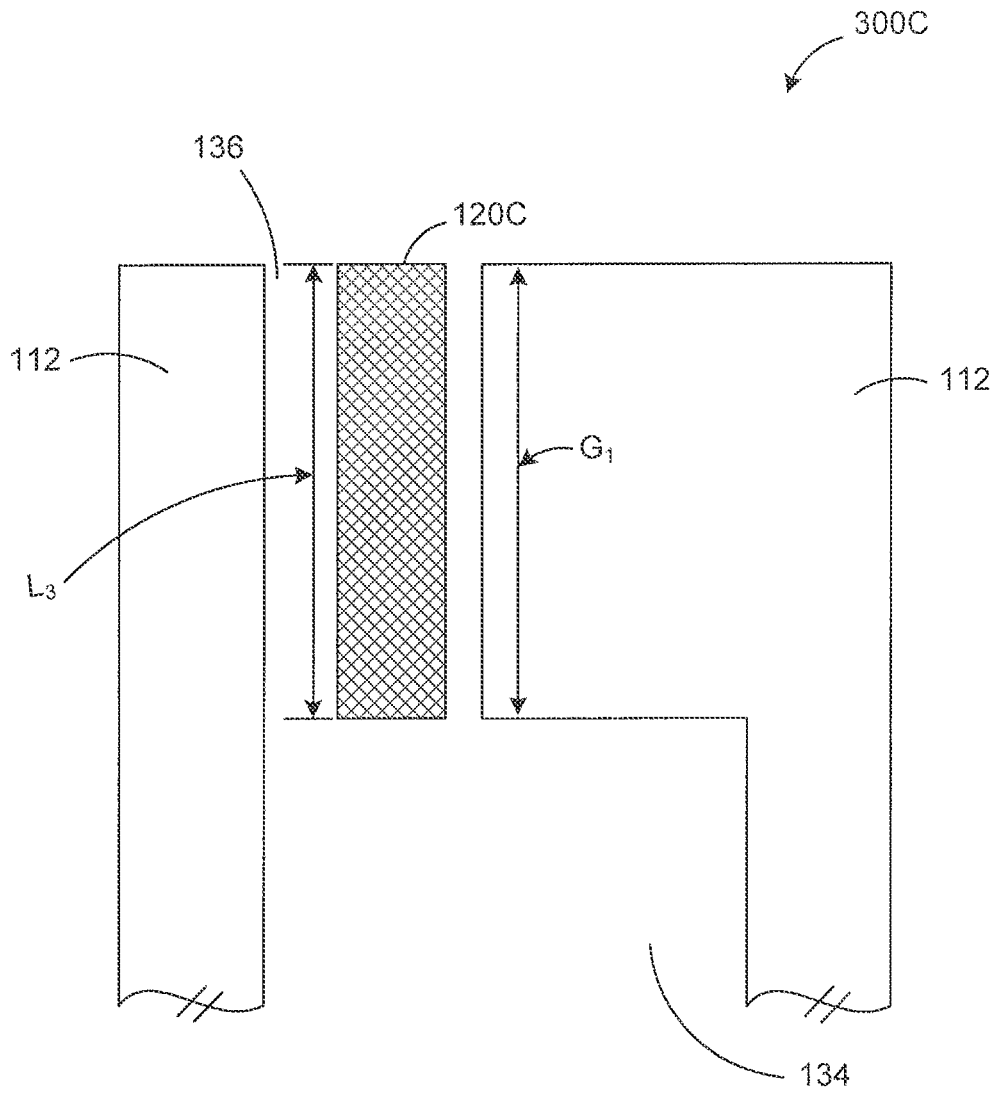

Referring now to FIGS. 3A to 3C, there are illustrated detailed section views of the air gap of acoustic transducer 100, according to various embodiments.

FIG. 3A illustrates an underhung topology for the motor of acoustic transducer 300A. In transducer 300A, air gap 136 generally has a length $G_1$. Moving coil 120A has a length $L_1$, which is less than length G1. Typically, length $L_1$ is significantly less than length $G_1$, for example less than 80% of length $G_1$.

The performance of an underhung topology may be generally limited by the thickness of the top plate of magnetic material 112, which can limit the physical displacement possible. Moreover, the short windings of the moving coil in an underhung topology can lead to high temperatures during operation, while the presence of the core and outside diameter of magnetic material 112 can result in high inductance and flux modulation.

However, because excursion of the moving coil is usually limited, and further because the moving coil remains wholly or mostly within regions of the air gap with generally linear magnetic flux, underhung topologies generally enjoy relatively linear performance characteristics.

FIG. 3B illustrates an overhung topology for the motor of acoustic transducer 300B. In transducer 300B, air gap 136 also has a length $G_1$. However, moving coil 120B has a length $L_2$, which is greater than length $G_1$. Typically, length $L_2$ is significantly greater than length $G_1$, for example more than 120% of length $G_1$.

In contrast to underhung topologies, an overhung topology may operate at lower temperatures due to the longer winding, and may be designed for relatively greater excursion. However, due to the non-linearities in the magnetic flux that exist at the edges of air gap 136, and further due to the non-linear or weak magnetic flux outside the air gap, significant distortion due to non-linear performance characteristics may be experienced by an overhung moving coil.

FIG. 3C illustrates a balanced or evenly-hung topology for the motor of acoustic transducer 300C. In transducer 300C, air gap 136 has a length $G_1$, and moving coil 120C has a length $L_3$, which is substantially equal to length $G_1$ (e.g., within about 5-10% of the length of $G_1$).

Where $G_1$ is large compared to the target excursion a balanced topology may enjoy similar linear performance (i.e., less distortion) to a conventional overhung design, while also providing greater excursion and better temperature performance than an underhung design. Moreover, the matched length of the air gap and the moving coil results in reduced reluctance for the same linear excursion, which allows significantly less magnetizing current to produce the same total flux. However, a balanced topology with a large $G_1$ $L_3$ would require a relatively thick top plate of magnetic material 112, which could significantly increase weight and cost of the transducer.

What is needed, therefore, is a way to extend the length of the moving coil, similar to an overhung design, and a way to extend the length of the air gap, similar to an underhung design, without making the top plate of the transducer impractically thick.

Figure 4:
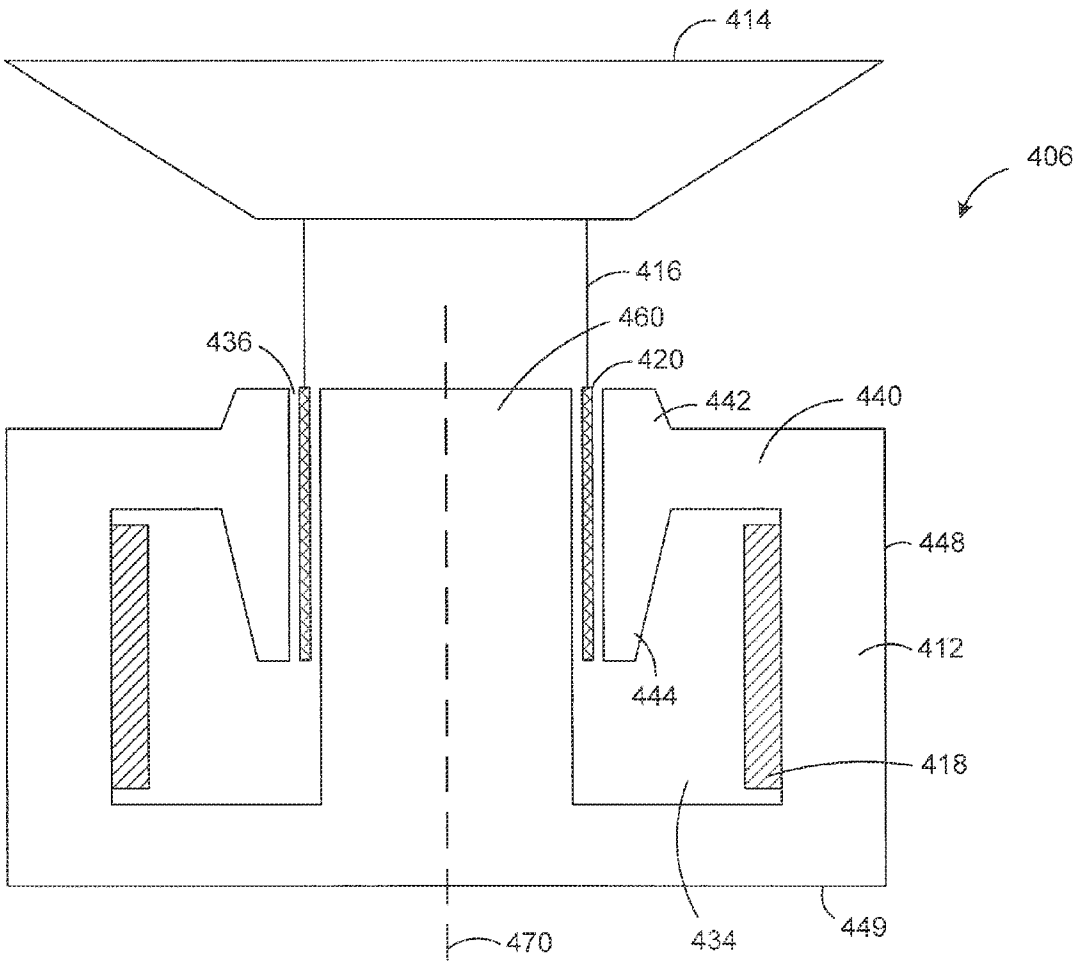
FIG. 4 is a perspective view of an example driver in accordance with an example embodiment.
Figure 5:
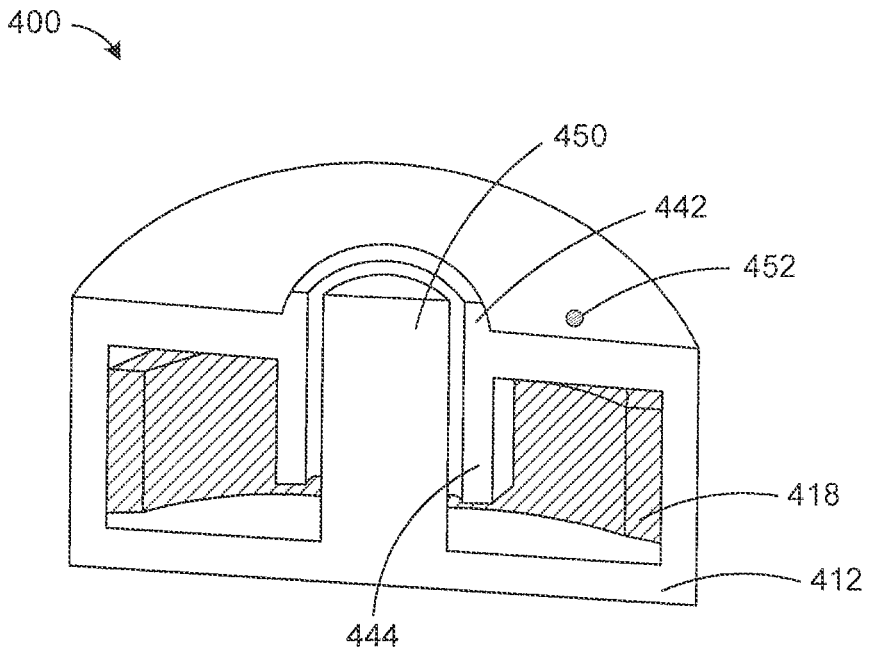
FIG. 5 is a cross-sectional view of the driver of FIG. 4.

Referring now to FIGS. 4 and 5, there are illustrated an example electromagnet-based acoustic transducer with balanced topology driver 400. FIG. 4 illustrates driver 406 in a perspective view and FIG. 5 illustrates driver 406 in a cross-sectional view.

Driver 406 is generally analogous to driver 106 of FIGS. 1 and 2. In particular, driver 406 includes magnetic material 412, a diaphragm 414, a moving coil former 416, a stationary coil 418 and a moving coil 420.

Magnetic material 412 is generally toroidal and has a toroidal cavity 434. Stationary coil 418 is positioned within cavity 434. In various embodiments, magnetic material 412 may be formed from one or more parts, which may allow stationary coil 418 to be inserted or formed within cavity 434 more easily. Magnetic material 412 is magnetized in response to the stationary coil signal, producing magnetic flux in the magnetic material. Magnetic material has a toroidal air gap 436 in its magnetic circuit 438 and magnetic flux flows through and near the air gap 436.

Magnetic material 412 may be formed of any material that is capable of becoming magnetized in the presence of a magnetic field. In various embodiments, magnetic material 412 may be formed from two or more such materials. In some embodiments, the magnetic material may be formed from laminations. In some embodiments, the laminations may be assembled radially and may be wedge shaped so that the composite magnetic material is formed with no gaps between laminations. In some embodiments, magnetic material 412 may be formed from two or more pieces, which may be assembled together via friction fit or another suitable assembly method.

In some embodiments, magnetic material may have one or more apertures 452 formed in a top plate, bottom plate or sidewall thereof, which can be used to route wires from control blocks, or for ventilation.

Moving coil 420 is mounted on moving coil former 416. Moving coil 420 may be coupled to a moving coil signal generation block, such as block 110 in transducer 100. Diaphragm 414 is mounted to moving coil former 416 such that diaphragm 414 moves together with moving coil 420 and moving coil former 416. The moving coil 420 and moving coil former 416 move within air gap 436 in response to a moving coil signal and the flux in the air gap. Components of the driver that move with the moving coil former may be referred to as moving components. Components that are stationary when the moving coil former is in motion may be referred to as stationary components. Stationary components of the acoustic transducer include magnetic material 412 and the stationary coil 418.

Magnetic material 412 comprises a top plate 440 that extends inwardly toward a center post 460, away from an outer extremity of the magnetic material 412. Proximate to the air gap 436, top plate 440 has an upper lip 442 lip disposed at an inward end of the annular plate and extending away from cavity 434 and the top plate 440 to extend the length of air gap 436, or a lower lip 444 disposed at an inward end of the annular plate and extending into cavity 434 also to extend the length of air gap 436, or both as illustrated. Top plate 440 generally forms an annular or toroidal plate, corresponding to the toroidal shape of magnetic material 412. Both the upper lip 442 and lower lip 444 are also generally annular or toroidal and serve to increase the thickness of the top plate in proximity to the air gap, thus increasing the effective length of the air gap. In some cases, the upper or lower lip may be tapered as it extends away from the top plate.

To mitigate distortion, the moving coil 420 may have a length that is at least 400%, and generally between 400% and 500% the length of the desired excursion. Alternatively, or in addition, the air gap may be extended to mitigate distortion. Likewise, other techniques may be used to shape the magnetic flux, as described in greater detail herein.

Referring now to FIGS. 6A to 6F, there are shown cross-sectional views of various alternate geometries for the driver. Various elements of the illustrated drivers, such as moving coil 420 and stationary coil 418, are not shown so as not to obscure the respective geometries.

Figure 6A:
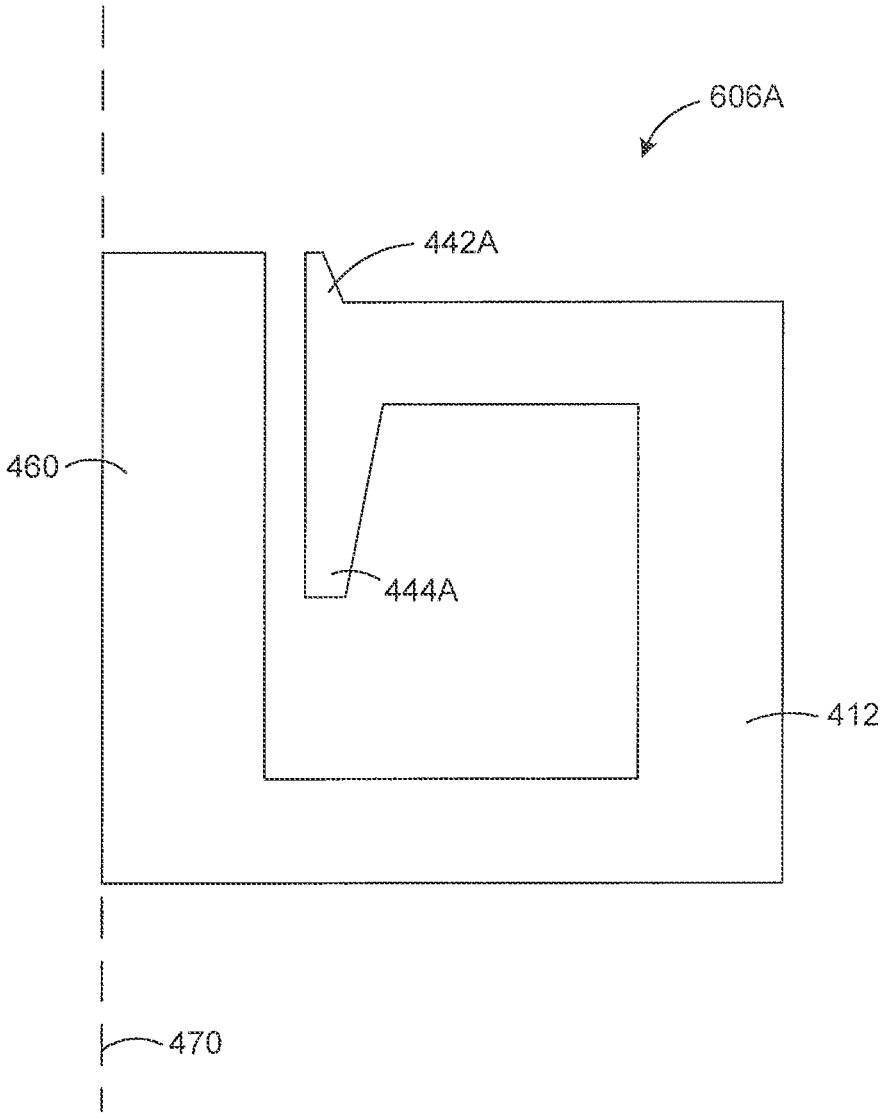
FIGS. 6A to 6F are cross-sectional views of various alternate geometries for the driver of FIG. 4.

Referring now to FIG. 6A, there is illustrated a driver 606A with magnetic material 412 comprising a center post 460. Driver 606A has an upper lip 442A that is generally shorter and narrower than lower lip 444A.

Figure 6B:
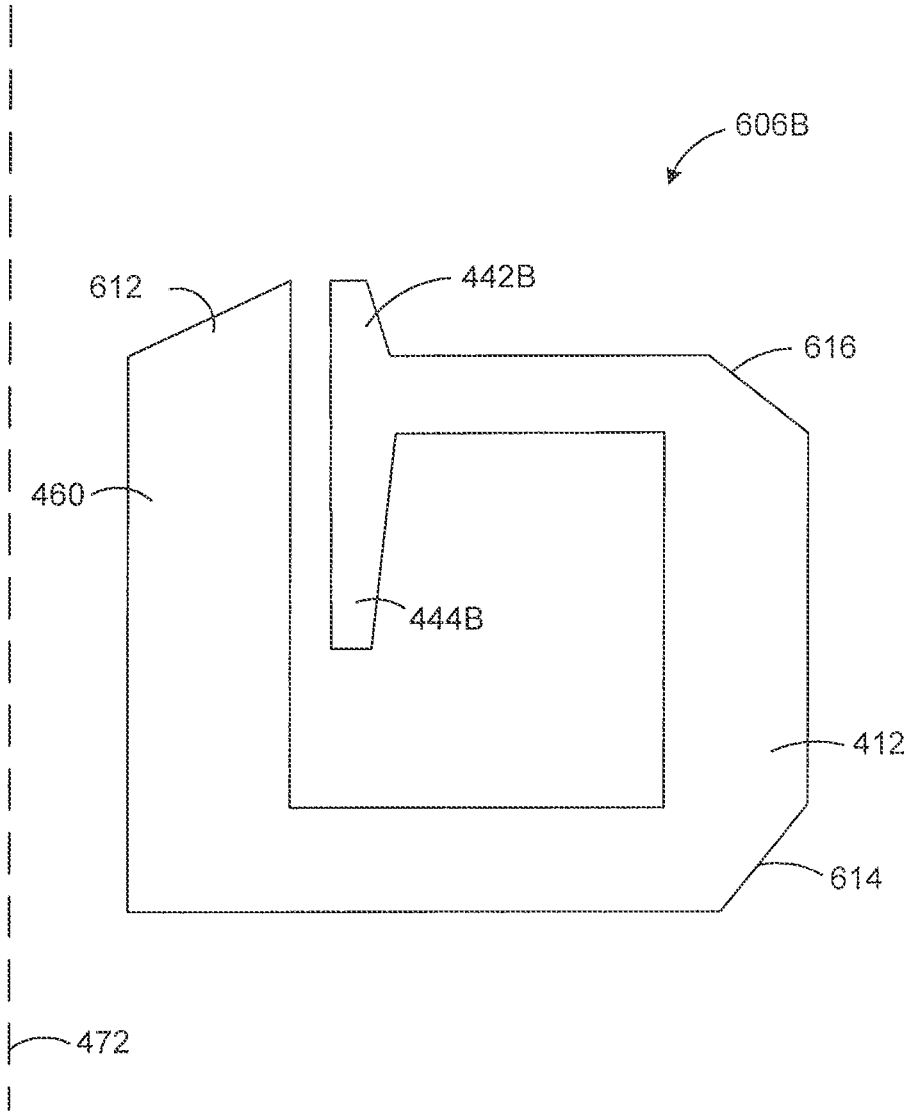

Referring now to FIG. 6B, there is illustrated a driver 606B with magnetic material 412 comprising a center post 460. Driver 606B has an upper lip 442B that is optionally shorter than lower lip 444B. Portions of the magnetic material 412 of driver 606B have been removed at 612, 614 and 616, resulting in tapered outer corners between the bottom portion and the outer wall and between the outer wall and annular plate. An upper interior portion of the center post is also tapered. The removed portions correspond to volumes of material with relatively low flux density as compared to the remaining magnetic material 412. Accordingly, removal of the low flux density portions has little or no effect on the flux or the performance of the driver, whale at the same time reducing weight and materials cost.

Figure 6C:
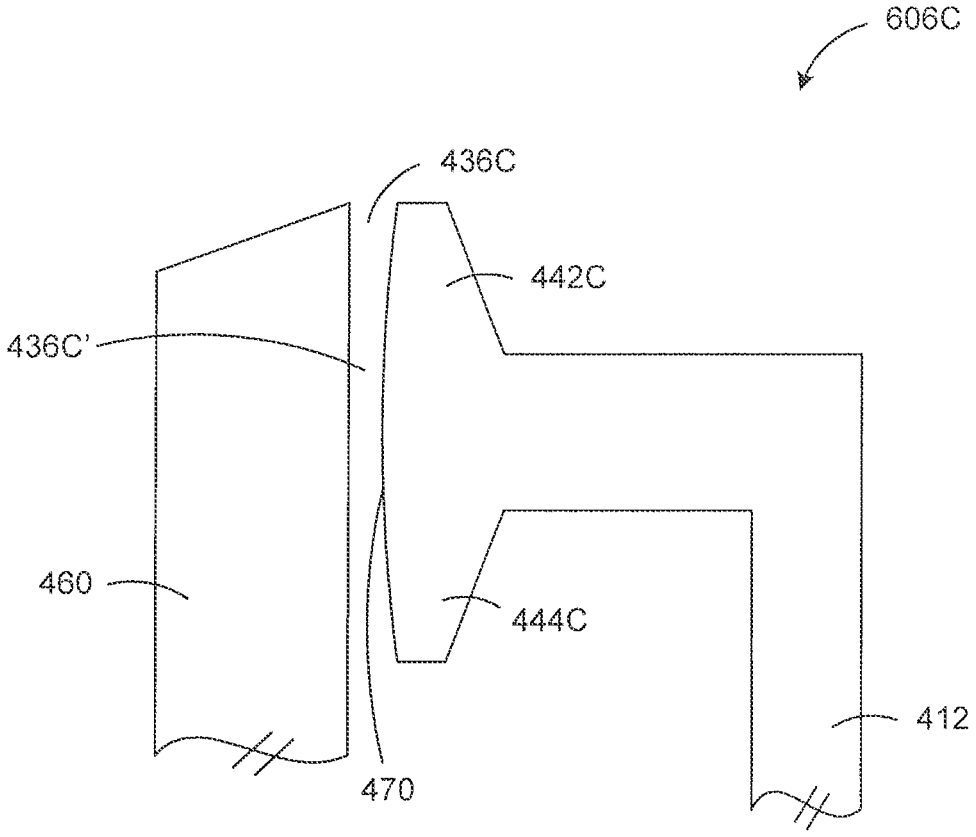

Referring now to FIG. 6C, there is illustrated a driver 606C with magnetic material 412 comprising a center post 460. Driver 606C has an upper lip 442C and a lower lip 444C. Driver 606C further has a shaped air gap 436C, in which the air gap from the center post 460 to the outer edge of upper lip 442C, or the outer edge of lower lip 444C, or both, is larger than the aft gap 436C' located inwardly of the respective outer edges. Accordingly, the air gap may have a greater width at an outward portion of the upper lip (or lower lip) than at a central portion of the annular plate. Furthermore, the inward face formed by the annular plate and any upper or lower lips is not parallel to the center post, resulting in the air gap being wider at an outer portion of the air gap and narrower at a central portion of the air gap.

Although a smoothly curving, convex or elliptical shape is illustrated in FIG. 6C, other geometries may also be used to reduce the air gap distance in the central portion of the air gap. For example, a triangular shape, stepped shape, parabolic shape, Gaussian curve shape or other shapes may be used.

The curved or tapered shape of the air gap results in the flux density being relatively higher in the central portion of the air gap. This generally increases linearity at high excursion as the BL (i.e., the moving coil length×flux density) in the central portion is still linked by the moving coil. This also has the effect of raising the BL for high excursion lengths.

Figure 6D:
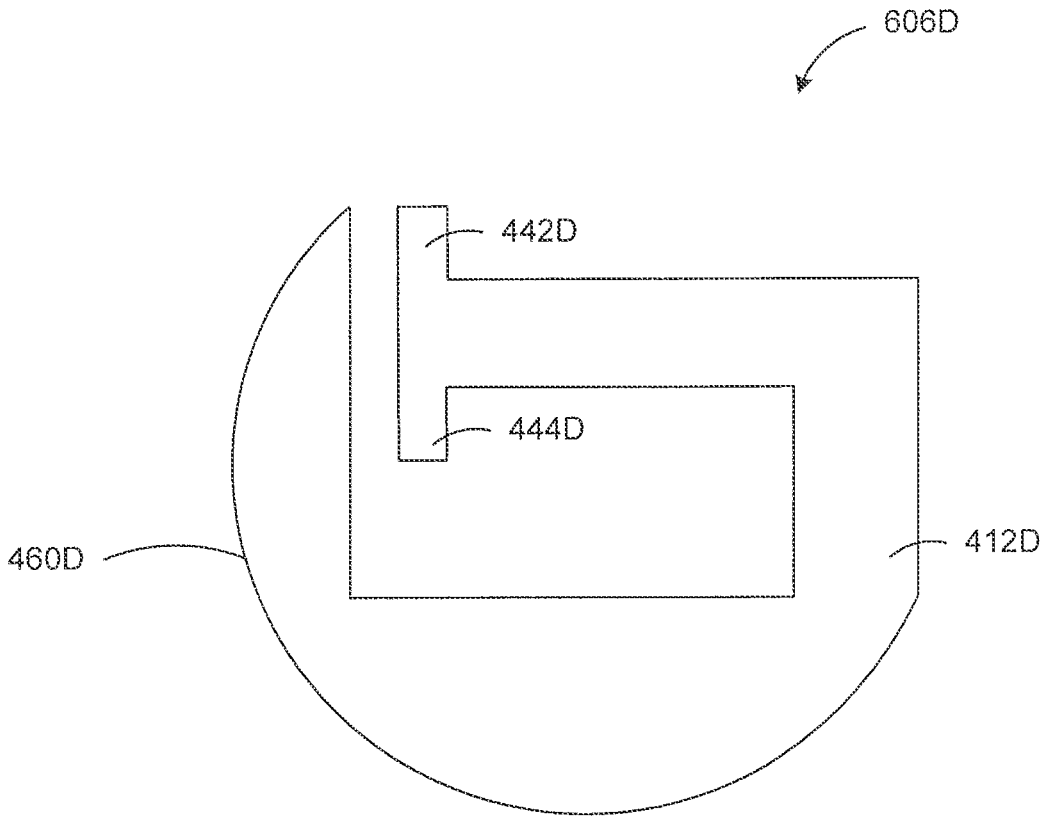

Referring now to FIG. 6D, there is illustrated a driver 606D with magnetic material 412D comprising a center post 460D. Driver 606D has an upper lip 442D and a lower lip 444D. Both center post 460D and magnetic material 412D of driver 606D have a radially rounded profile. As with driver 6060 of FIG. 60, the rounded profile eliminates portions of magnetic material that contain relatively low flux density.

Figure 6E:
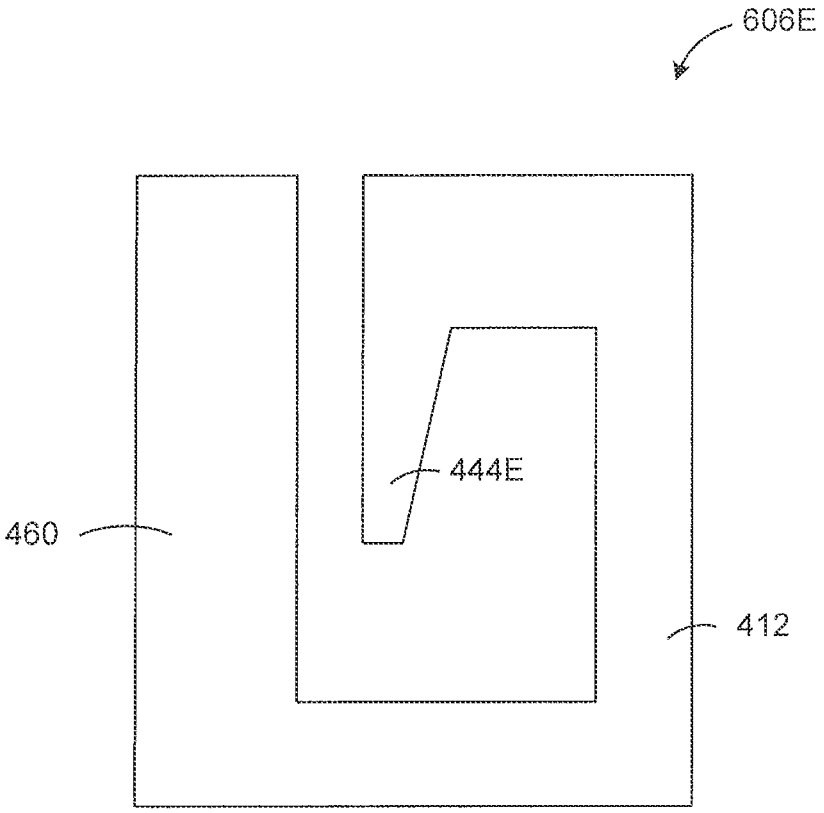

Referring now to FIG. 6E, there is illustrated a driver 606E with magnetic material 412 and center post 460. Driver 606E has only a lower lip 444E.

Figure 6F:
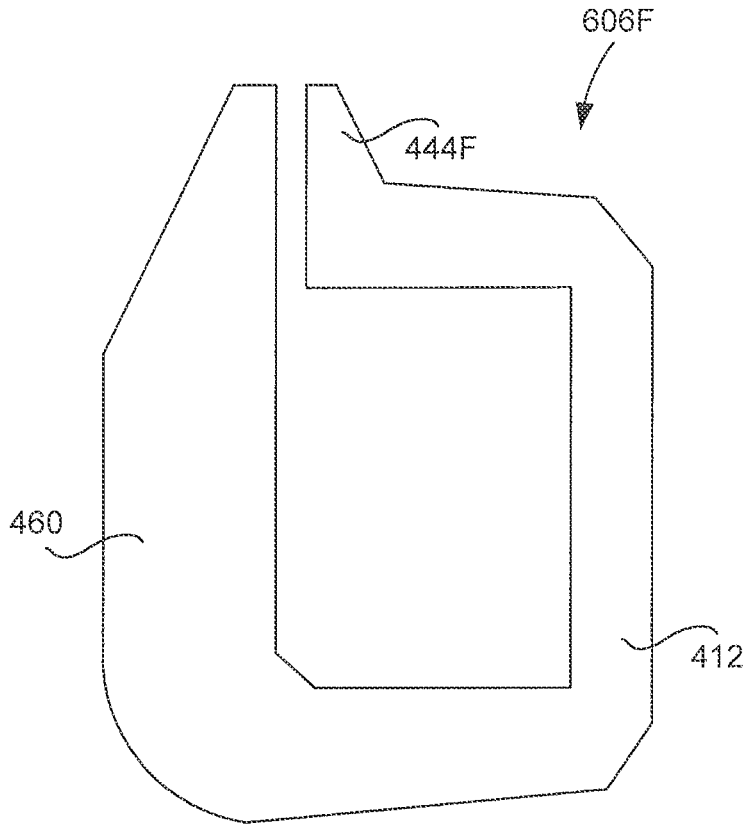

Referring now to FIG. 6F, there is illustrated a driver 606F with magnetic material 412 and center post 460. Driver 606F has only an upper lip 444F.

Figure 7:
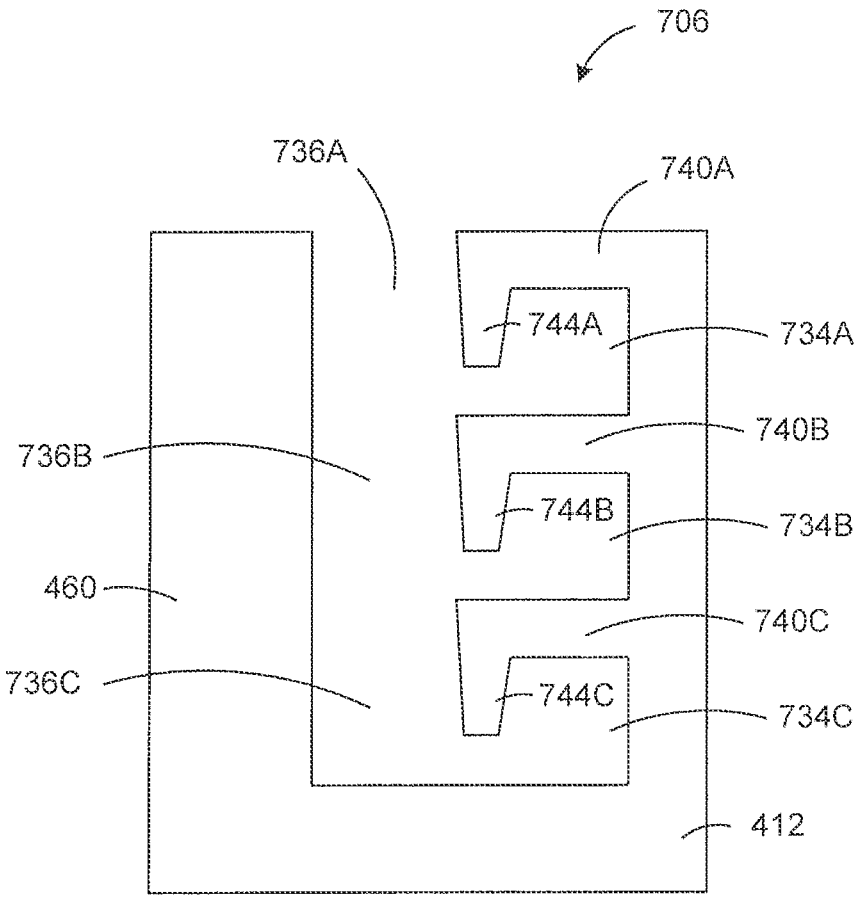
FIG. 7 is a cross-sectional view of another example driver.

Referring now to FIG. 7, there is illustrated a driver 706 with magnetic material 412 and center post 460. In contrast to driver 406 of FIG. 4, driver 706 has a plurality of annular plates 740A, 7403 and 740C, each of which comprises respective lower lips 744A, 744B and 744C. In some embodiments, each of annular plate 740A, 7403 and 740C may have an upper lip (not shown), either alone, or in combination with the respective lower lips.

Cavity portions 734A, 7343 and 734C, formed by the lower lips or, where present, the upper lips of the annular plates, may contain separate stationary coils (not shown). Likewise, a plurality of moving coils (not shown) may be provided, corresponding to the respective air gaps 736A, 7363 and 736C formed between center post 460 and lower lips 744A, 7443 and 744C.

In order to prevent cancellation of the magnetic field from adjacent coils, the area of winding window for the stationary coils increases progressively from cavity portion 734A to 734C, such that the stationary coils increase in size from "top" to "bottom". This drives flux into the center of the driver 706.

Figure 8:
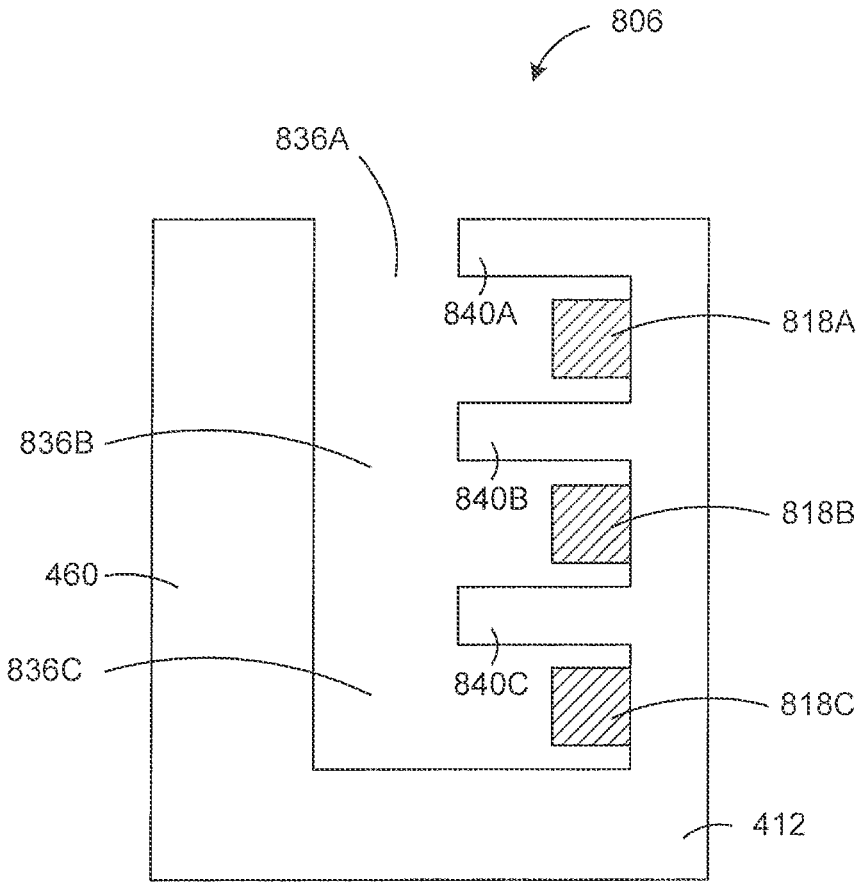
FIG. 8 is a cross-sectional view of yet another example driver.

Referring now to FIG. 8, there is illustrated a driver 806 with magnetic material 412 and center post 460. Driver 806 is generally analogous to driver 706, with the exception that annular plates 840A, 840B and 840C lack upper or lower lips.

In driver 806, air gaps 836A, 8363 and 836C are sized to create a thick air gap relative to the heights of stationary coils 818A, 818B and 818C, respectively. The creation of such a thick air gap results in fringing of the magnetic flux, which results in a smoothing out of flux density over the air gap.

Figure 9:
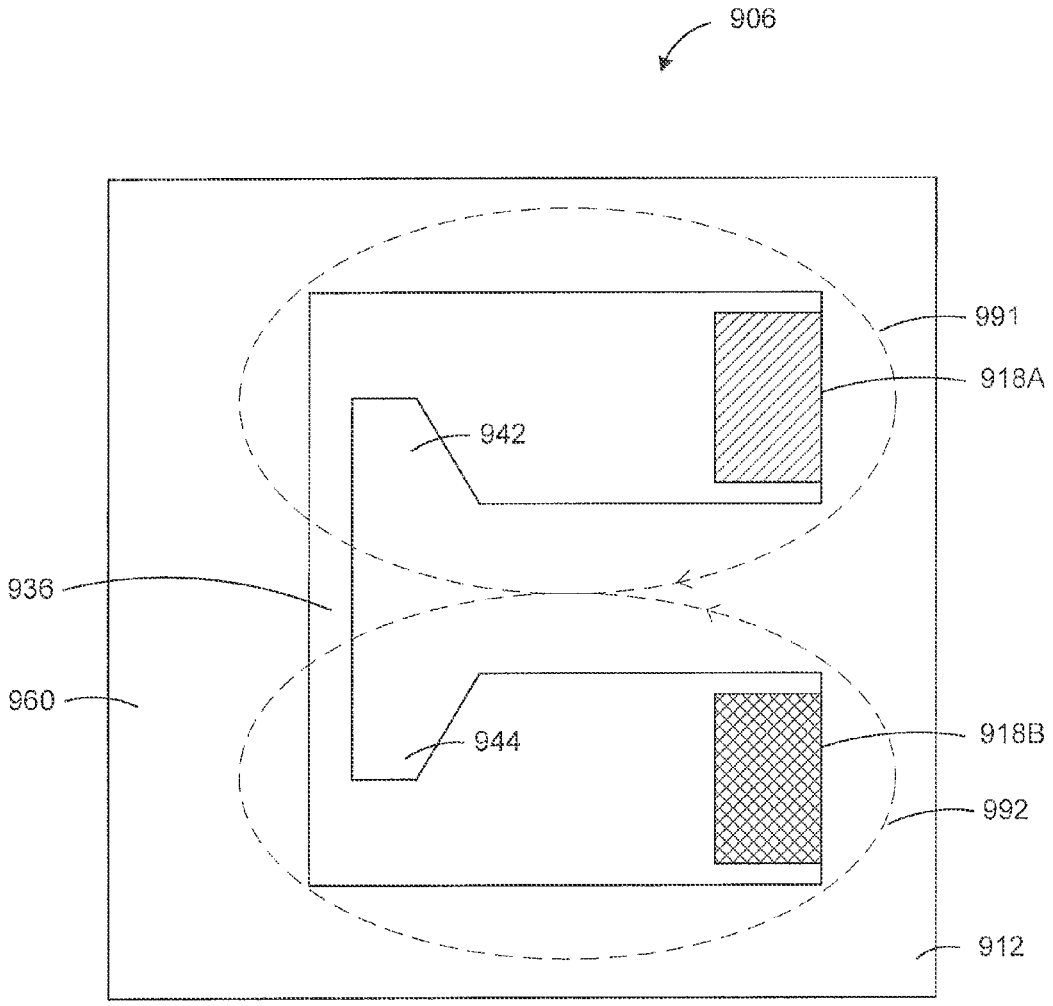
FIG. 9 is a cross-sectional view of still another example driver.

Referring now to FIG. 9, there is illustrated a driver 906 with magnetic material 912 and center post 960. Driver 906 is generally analogous to driver 406, with the exception that a top portion of driver 906 is in contact with center post 960, such that the air gap 936 is contained within driver 906.

Driver 906 comprises two stationary coils 918A and 918B, which are arranged in a push-pull fashion. Accordingly, stationary coil 918A contributes to a magnetic flux path 991, whereas stationary coil 918B contributes to an opposing magnetic flux path 992 rotating in the opposite direction to flux path 991. As a result, most or all magnetic flux can be completely contained within magnetic material 912, so that it passes through a moving coil (not shown). This may result in an efficiency gain of between 20-30% over an open air gap design. However, a suitable attachment for the voice coil to the speaker cone must be provided, for example by providing one or more posts passing through one or more apertures in the magnetic material.

The various embodiments described above are described at a block diagram level and with the use of some discrete elements to illustrate the embodiments. Embodiments of the invention, including those described above, may be implemented in a digital signal process device.

The present invention has been described here by way of example only. Various modification and variations may be made to these exemplary embodiments without departing from the spirit and scope of the invention, which is limited only by the appended claims.

I claim:

1. A driver for an acoustic transducer comprising:

a moving diaphragm;

a driver body formed of a magnetic material, the driver body comprising:

a center post;

an outer wall coupled to the center post via a bottom portion of the driver body; and an annular plate extending inwardly toward the center post from the outer wall;

a moving coil coupled to the diaphragm, the moving coil disposed at least partially within an air gap formed between the annular plate and the center post;

a stationary coil disposed within a cavity defined by the annular plate, outer wall, bottom portion and center post, the stationary coil being operable to magnetize the magnetic material for inducing magnetic flux in the air gap; and at least one additional annular plate, the at least one additional annular plate defining at least one additional air gap and at least one additional cavity.

2. The driver of claim 1, wherein the annular plate comprises an upper lip disposed at an inward end of the annular plate, the upper lip extending away from the cavity to extend the air gap.

3. The driver of claim 2, wherein the air gap has a greater width at an outward portion of the upper lip than at a central portion of the annular plate.

4. The driver of claim 2, wherein width of the upper lip is tapered to be narrower as the upper lip extends away from the annular plate.

5. The driver of claim 1, wherein the annular plate comprises a lower lip disposed at an inward end of the annular plate, the lower lip extending into the cavity to extend the air gap.

6. The driver of claim 5, wherein the air gap has a greater width at an outward portion of the lower lip than at a central portion of the annular plate.

7. The driver of claim 5, wherein width of the lower lip is tapered to be narrower as the lower lip extends away from the annular plate.

8. The driver of claim 1, wherein the moving coil has a moving coil length that is substantially equal to an air gap length of the air gap.

9. The driver of claim 8, wherein the moving coil length is at least 400% of a maximum excursion of the moving coil.

10. The driver of claim 1, wherein the driver body has a tapered outer corner between the bottom portion and the outer wall.

11. The driver of claim 1, wherein the driver body has a tapered outer corner between the outer wall the annular plate.

12. The driver of claim 1, wherein the driver body has a tapered upper interior portion of the center post.

13. The driver of claim 1, wherein an inward face of the annular plate is not parallel to the center post.

14. The driver of claim 13, wherein the air gap is wider at an outer portion of the air gap and narrower at a central portion of the air gap.

15. The driver of claim 1, wherein an inward portion of the at least one additional annular plate is coupled to an upper portion of the center post, further comprising an additional stationary coil disposed within the at least one additional cavity, wherein the additional stationary coil has an additional flux path rotating in an opposite direction to a flux path of the stationary coil.

16. The driver of claim 1, further comprising at least one additional moving coil respectively disposed within the at least one additional air gap; and at least one additional stationary coil respectively disposed within the at least one additional cavity.

17. An acoustic transducer comprising:

an audio input terminal for receiving an input audio signal;

a control system for:

producing at least one time-varying stationary coil signal, wherein the stationary coil signal corresponds to the audio input signal; and producing at least one time-varying moving coil signal, wherein the moving coil signal corresponds to the audio input signal and the stationary coil signal; and driver according to claim 1, the driver electrically coupled to the control system.

* * * * *